US008341772B1

(12) United States Patent
Flores

(10) Patent No.: US 8,341,772 B1
(45) Date of Patent: Jan. 1, 2013

(54) WORKOUT GARMENT

(76) Inventor: Alfred Flores, Los Angeles, CA (US)

( * ) Notice: Subject to any disclaimer, the term of this patent is extended or adjusted under 35 U.S.C. 154(b) by 223 days.

(21) Appl. No.: 12/656,257

(22) Filed: Jan. 22, 2010

Related U.S. Application Data

(60) Provisional application No. 61/202,040, filed on Jan. 22, 2009.

(51) Int. Cl.
*A41D 27/26* (2006.01)

(52) U.S. Cl. ..... 2/460; 2/461

(58) Field of Classification Search ..... 2/460, 461, 2/462, 112, 117, 309, 310, 311, 312, 313, 2/115, 69; 128/874, 875, 878; 450/2; 602/20, 602/5, 19; 473/207, 212, 59, 450, 458, 464
See application file for complete search history.

(56) References Cited

U.S. PATENT DOCUMENTS 1,136,307 A * 4/1915 Bourdon ..... 2/456
1,263,841 A * 4/1918 Bartholomew ..... 602/20
3,158,872 A * 12/1964 Pantzke ..... 2/115
3,446,880 A * 5/1969 Enicks ..... 264/46.6
5,819,322 A * 10/1998 Dicker et al. ..... 2/456
5,960,474 A * 10/1999 Dicker et al. ..... 2/69
6,152,891 A * 11/2000 Carlson ..... 602/4
6,398,746 B2 * 6/2002 Bramlage et al. ..... 602/5
6,745,400 B1 * 6/2004 Paciorkowski ..... 2/69
6,979,303 B2 * 12/2005 Jestrabek-Hart ..... 602/4
7,207,963 B2 * 4/2007 Kania et al. ..... 602/20
7,257,846 B2 * 8/2007 Paciorkowski ..... 2/267
7,615,022 B2 * 11/2009 Nordt et al. ..... 602/5
7,785,281 B2 * 8/2010 Scott ..... 602/4
7,854,026 B2 * 12/2010 Phaneuf et al. ..... 2/461
2002/0010409 A1 * 1/2002 Bramlage et al. ..... 602/19
2002/0112275 A1 * 8/2002 Hall ..... 2/310
2004/0216213 A1 * 11/2004 Paciorkowski ..... 2/69
2011/0130693 A1 * 6/2011 Avery ..... 602/20
2012/0022421 A1 * 1/2012 Matthias ..... 602/20

* cited by examiner

*Primary Examiner* — Khoa Huynh
*Assistant Examiner* — Sally Haden
(74) *Attorney, Agent, or Firm* — Steptoe & Johnson LLP

(57) ABSTRACT

The invention provides a workout garment for protecting a wearer from injury while the wearer exercises. The garment includes a plurality of supporting straps for providing customziably adjustable support to the shoulders and arms of the wearer. The supporting straps may be wrapped around the wearer's arms at a tightness suitable to accommodate the wearer's desired amount of support and comfort. Wrapping the straps tighter will provide increased support. Wrapping the straps looser will provide less support but may be more comfortable.

12 Claims, 2 Drawing Sheets

WORKOUT GARMENT

RELATED U.S. APPLICATIONS

The present application claims priority to U.S. Provisional Application No. 61/202,040, filed Jan. 22, 2009, entitled, "Workout Shirt."

FIELD OF THE INVENTION

The present invention relates to a garment for athletic support during exercise. In particular, the invention relates to a garment that can be customizably adjusted by the wearer to accommodate the wearer's desired level of support and comfort for the shoulders, arms, and/or upper torso.

BACKGROUND OF THE INVENTION

Recent scientific research has shown the benefits of weight training for overall health and fitness. Although weight training was once practiced exclusively by athletes and bodybuilders, the exercise has become a popular activity for many people seeking improved health and fitness. In addition to improving performance for competitive athletes, weight training provides many benefits for ordinary people, including reducing body fat, increasing muscle mass, strengthening joints and bones, and improving health.

The bench press is an example of a popular and effective weightlifting exercises. The bench press is a compound exercise that works out multiple muscle groups in the upper body including the pectorals, deltoids, and triceps. These exercises are particularly useful for building muscle mass and strength in the upper body. Additionally, there are other exercises that specifically target the upper body including, but not limited to, the chest fly, the pushup, the pull-up, the shoulder press, etc.

Despite the many benefits of weight training, exercise can cause serious athletic injury if performed incorrectly. Injury is especially common among beginners who may not have proper technique or may have not developed enough strength. Overtraining, repetitive stress, and improper positioning may also cause significant injury. Such injuries may occur while exercising both with free weights or with specialized exercise machines. The risk of injury creates a difficult dilemma for beginner weightlifters needing to develop strength to avoid injury yet limited from excessive train for fear of being injured. With the upper body exercises particularly, injury to the shoulder is prevalent because the shoulder muscles are relatively weak in comparison to the chest muscles. Common injuries include tears in the front deltoid, tears in the chest muscle, and dislocation of the shoulder joint.

Many attempts have been made to reduce the risk of injury while weight training. Exercisers will often wrap adhesive tape around shoulders and other joints in order to provide additional support to the joints and muscles. Although this method is effective in preventing injury, another person is usually needed to apply the tape as it is extremely difficult to adequately tape oneself. Additionally, the tape wraps are difficult to adjust or remove once applied and are generally not reusable once removed.

Moreover, there are many examples in the prior art of garments designed to protect the wearer from external injuries, e.g., injuries caused by free weights being dropped on the wearer. These garments do not, however, address the internal types of injuries that a wearer may incur by overtraining or improper lifting, etc.

Recently, competitive weightlifters have popularized the use of specialized "bench press shirts". These shirts are usually made out of strong material such as denim or stiff polyester and fit tightly around the wearer. Because these shirts need to be tight, they are usually very difficult to put on or take off and are extremely uncomfortable. Thus, specialized bench press shirts are normally favored only among elite weightlifters looking for an extra competitive edge. Because bench press shirts are produced in fixed sizes, the shirts cannot be customizably adjusted to each individual person's unique body shape and/or physique. Moreover, a person's physique may change as the person's muscles develop as a result of training. Furthermore, injuries or stresses may make it desirable to provide different amounts of support to different areas of the body. A bench press shirt is unable to be adjusted to account for these changes and differences.

Therefore, there exists a need for a reusable, low-cost workout garment that is customizably adjustable to accommodate different body sizes.

SUMMARY OF THE INVENTION

The present invention relates to a workout garment for athletic support during exercise. In particular, the invention relates to a garment that can be customizably adjusted by the wearer to accommodate the wearer's desired level of support and comfort for the shoulders, arms, and/or upper torso.

The workout garment provides protection from certain injuries to a wearer while the wearer exercises. The garment is manufactured from a sturdy fabric, e.g. cotton, and comprises a front panel, a rear panel, and a plurality of supporting straps. The garment can be in the form of a sleeveless vest or as a full t-shirt. One end of each strap is fastened to the shirt can be located along the sleeve to provide support to the shoulders, elbows, or wrists. The free end of each strap is wrappable around the wearer's arm to provide support at that location. A hook and loop strip, commonly known as Velcro®, is positioned on the end of each strap to securely fasten the strap. This allows the wearer to easily adjust the tightness of the wrapping in order provide the desired amount of comfort and support.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION OF THE INVENTION

The present disclosure will now be described more fully with reference to the Figures in which various embodiments of the present invention are shown. The subject matter of this disclosure may, however, be embodied in many different forms and should not be construed as being limited to the embodiments set forth herein.

Figure 1:
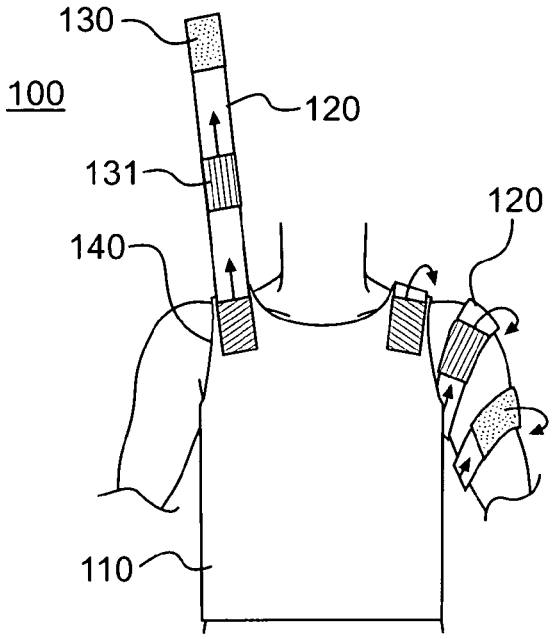
FIG. 1 illustrates a workout garment according to one embodiment of the present invention.

FIG. 1 illustrates a workout garment incorporating one embodiment of the present invention. The workout garment 100 may include a vest 110 with attached shoulder straps 120. The vest 110 may comprise a front panel and a rear panel made from cotton, polyester, or any type of clothing fabric known to one of skill in the art. The front and rear panels may be sewn together to form a sleeveless shirt with shoulder areas 140.

In one embodiment, two shoulder straps 120, one for each arm, may be fastened to the vest 110 at shoulder areas 140. The supporting straps 120 may be made from an elastic, stretchable, fabric (e.g., Lycra® or Spandex) and may be fastened at one end to the shoulder areas 140 by sewing, gluing, or any other means of attachment known to one of skill in the art. Shoulder straps 120 may be substantially long enough to wrap around the shoulder and upper arm area multiple times. The "hook" side of a Velcro fastener 130 may be affixed to the free end of the strap 120 that is not attached shoulder area 140. The "loop" side of the Velcro fastener 131 may be attached to the middle of the strap 120 on the side opposite from the "hook" side of the Velcro. Alternatively, it would be known to one of skill in the art that the "hook" and "loop" sides of the Velcro may be reversed. The Velcro fasteners may be of sufficient length so that the strap may be tightly secured when wrapped around the wearer's body. Furthermore, the Velcro fastener 131 may be of sufficient size to allow a range of areas where Velcro fastener 130 may adhere to when the strap is wrapped around the wearer's body. This design allows the tightness of the wrap to be customizably adjusted.

To use the work out garment 100, a wearer may wear the vest 110 over his or her upper torso so that the shoulder straps 120 are positioned over the wearer's shoulder. The wearer may then wrap each supporting strap around the shoulder and upper arm area corresponding to the strap. The Velcro fastener 130 adheres to Velcro fastener 131 when the strap is wrapped around a wearer's arm and shoulder. If the straps are wrapped tightly, the straps may be less comfortable but will provide more support to the wearer. Alternatively, the straps may be wrapped looser for less support but better comfort. This design allows the wearer to customizably adjust the tightness of the wrap to accommodate a wearer's desired level of comfort and support. This design also allows the supporting garment to accommodate each wearer's individual size and shape.

Figure 2:
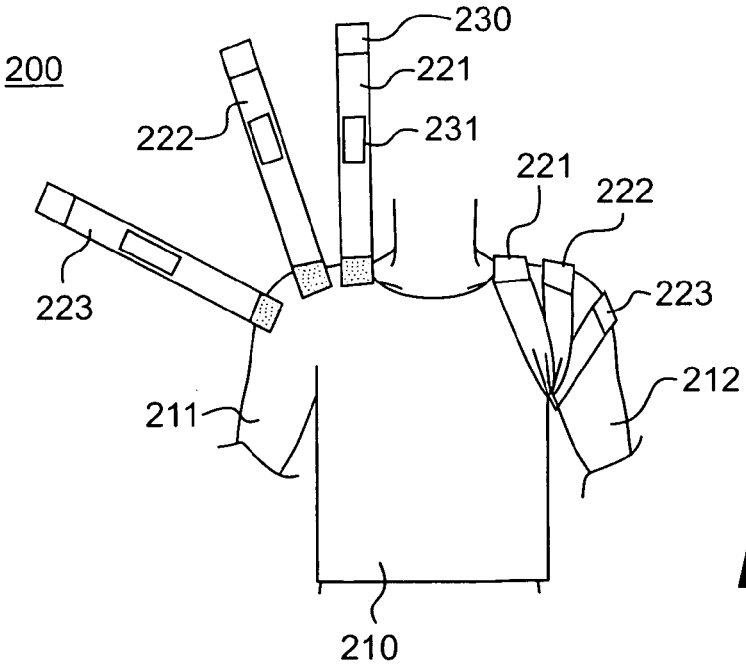
FIG. 2 illustrates a workout garment according to one embodiment of the present invention.

FIG. 2 illustrates a work out garment according to one embodiment of the present invention. The work out garment 200 may include a shirt 210 with sleeves 211 and 212. The shirt 210 may comprise a front panel and a rear panel made from cotton, polyester, or any type of clothing fabric known to one of skill in the art. The work out garment 200 may include sets of three supporting straps, 221, 222, and 223, attached to the each of the shoulder areas of shirt 210. The set of straps may wrap around the respective shoulder and upper arm to provide adjustable support to the wearer.

The supporting straps 221, 222, and 223 may be made from an elastic, stretchable, fabric (e.g., Lycra or Spandex) and may be fastened at one end to the shoulder area by sewing, gluing, or any other means of attachment known to one of skill in the art. In one embodiment, the supporting straps may each be 2 inches wide and 23 inches long. One skilled in the art would understand, however, that other strap widths and/or lengths could be used. For instance, if the garment were intended for use by a child, the width and length of the straps may be adjusted appropriately. The "hook" side of a Velcro fasteners 230 may be attached to the free end of each strap that is not attached the shirt 210. The "loop" side of the Velcro fasteners 231 may be attached to the middle of each strap on the side opposite from the "hook" side of the Velcro. Alternatively, it would be known to one of skill in the art that the "hook" and "loop" sides of the Velcro may be reversed. The Velcro fasteners may be of sufficient length so that the strap may be tightly secured when wrapped around the wearer's body. Furthermore, the Velcro fastener 231 may be of sufficient size to allow a range of areas where Velcro fastener 230 may adhere to when the strap is wrapped around the wearer's body. This design allows the tightness of the wrap to be customizably adjusted.

When wearing the garment 200, each of the straps may be adjustably wrapped around the shoulder and arm to accommodate the wearer's desired level of support and comfort. The Velcro fasteners 230 adheres to the Velcro fasteners 231 when the straps are wrapped roughly one and a half times around the wearer's arm and shoulder. A tighter wrap will provide more support while a looser wrap will provide more comfort. One of skill in the art would understand that that number of times the strap is wrapped around the wearer's body may be altered by changing the length of the strap and repositioning the Velcro fasteners. For example, it may be desirable to further improve support by using a longer strap that would allow for more wraps around the wearer's body.

The first strap 221 may be attached to the shirt so that it is located over the wearer's clavicle. The first strap 221 stabilizes the acromio-clavicular region allowing the humeral head to smoothly pass under the coricoid process and into the gleno-humeral cavity during abduction. The second strap 222 may be located about an inch away from the first strap 221 so that it can wrap around the wearer's scapula. The second strap 222 envelopes the humeral head and stabilizes the joint further by providing medial pressure toward the gleno-humeral joint, thus allowing an increase in external rotation of an injured upper extremity. The third strap 223 may be located about a half inch away from the second trap 222, making it wrappable around upper portion of the humerus. When tightened, the third strap 223 provides a constant pressure against the tendons, allowing an increase in range of motion to an injured shoulder. The amount of support provided by each strap may be customizably adjusted to suit the wearer's preference and comfort.

Figure 3:
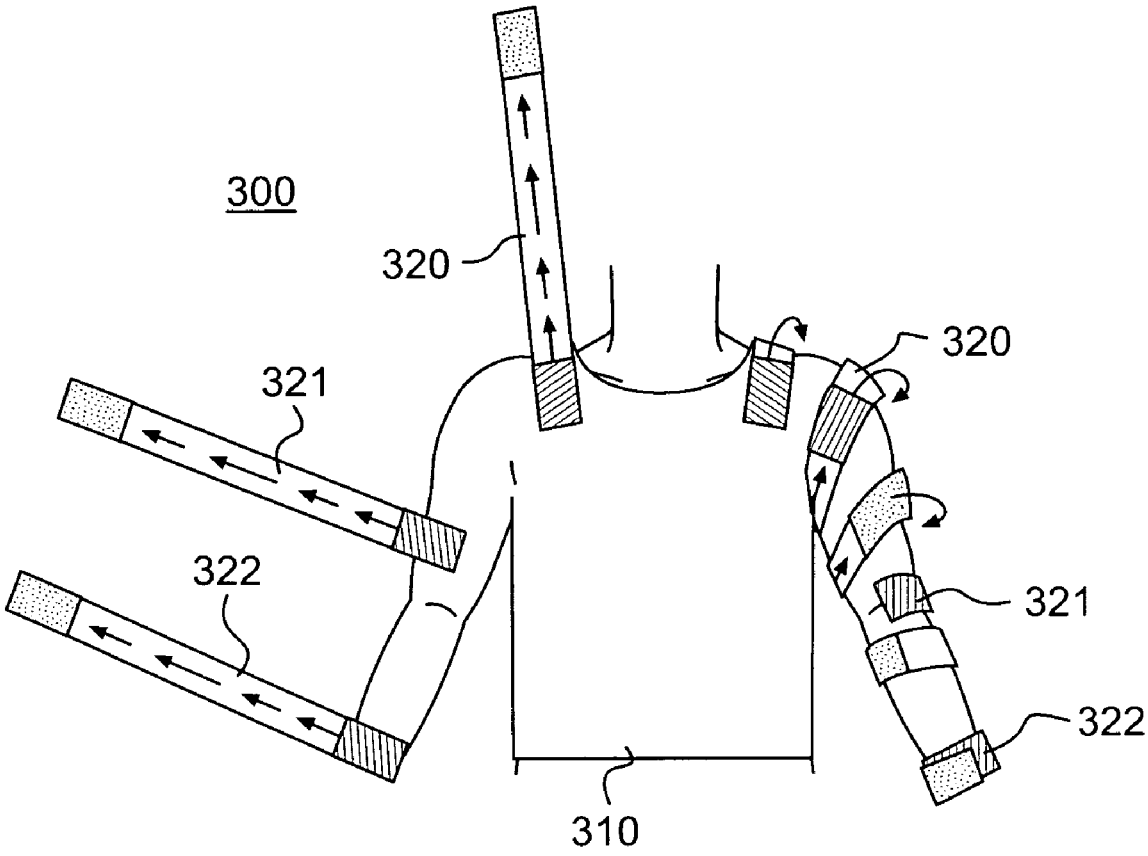
FIG. 3 illustrates a workout garment according to another embodiment of the present invention.

FIG. 3 illustrates a work out garment according to another embodiment of the present invention. The work out garment 300 may include a shirt 310 with sleeves 311 and 312. The shirt 310 may comprise a front panel and a rear panel made from cotton, polyester, or any type of clothing textile as would be known to one of skill in the art. The work out shirt 300 may include shoulder straps 320 that function in the same manner as described in the above embodiments. Additionally, work out garment 300 may also include elbow straps 321 and wrist straps 322, comprising similar material and design as shoulder straps 320, attached to the sleeves at the elbow and wrist areas respectively. A wearer may use elbow straps 321 and wrist straps 322 to provide customizably adjustable support to the elbows and wrists.

The foregoing descriptions of specific embodiments of the present invention are presented for purposes of illustration and description. They are not intended to be exhaustive or to limit the invention to the precise forms disclosed. Obviously, many modifications and variations are possible in view of the above teachings. While the embodiments were chosen and described in order to best explain the principles of the invention and its practical applications, thereby enabling others skilled in the art to best utilize the invention, various embodiments with various modifications as are suited to the particular use are also possible. The scope of the invention is to be defined only by the claims appended hereto, and by their equivalents.

What is claimed is:

1. An adjustable shoulder and arm supporting garment comprising:

a shirt with a front panel, a rear panel, and left and right shoulder areas; and a shoulder supporting strap having a proximal end and a distal end, wherein the proximal end of the strap is attached directly to a clavicle region of either the left or right shoulder area of the shirt and adapted to locate over a clavicle of a person wearing the garment;

wherein said shoulder supporting strap that is attached to either the left or right clavicle region of the shoulder area of the shirt is designed to adjustably wrap more than one time circumferentially around the shoulder area of the shirt from the clavicle region of the person wearing the garment and extending toward an elbow of the person wearing the garment.

2. The adjustable shoulder and arm supporting garment of claim 1, wherein said shoulder supporting strap comprises elastic fabric.

3. The adjustable shoulder and arm supporting garment of claim 1, wherein said shoulder supporting strap comprises a hook and loop fastener material.

4. The adjustable shoulder and arm supporting garment of claim 3, wherein the hook and loop fastener material is located at the proximal end of the shoulder supporting strap.

5. The adjustable shoulder and arm supporting garment of claim 1, further comprising at least three shoulder supporting straps attached at proximal ends to either the left or right shoulder area of the shirt.

6. The adjustable shoulder and arm supporting garment of claim 1, wherein said shirt further comprises sleeves.

7. The adjustable shoulder and arm supporting garment of claim 6, wherein said sleeves comprise elbow supporting straps configured to adjustably wrap circumferentially around an elbow of the person wearing the garment.

8. The adjustable shoulder and arm supporting garment of claim 6, wherein said sleeves comprise wrist supporting straps configured to adjustably wrap circumferentially around a wrist of the person wearing the garment.

9. An adjustable shoulder and arm supporting garment comprising:

a shirt with a front panel, a rear panel, and left and right shoulder areas; and left and right shoulder supporting straps, each shoulder supporting strap having a proximal end and a distal end, wherein the proximal end of the left shoulder supporting strap is attached directly to a clavicle region of left shoulder area of the shirt and adapted to locate over the left clavicle of a person wearing the garment, and the proximal end of the right shoulder supporting strap is attached directly to a clavicle region of the right shoulder area of the shirt and adapted to locate over the right clavicle of the person wearing the garment; wherein the left shoulder supporting strap is designed to adjustably wrap more than one time circumferentially around the left shoulder area of the shirt from the clavicle of the person wearing the garment and extending toward an elbow of the person wearing the garment, and wherein the right shoulder supporting strap is designed to adjustably wrap more than one time circumferentially around the right shoulder area of the shirt from the clavicle of the person wearing the garment and extending toward an elbow of the person wearing the garment.

10. The adjustable shoulder and arm supporting garment of claim 9, wherein said shirt further comprises sleeves.

11. The adjustable shoulder and arm supporting garment of claim 10, wherein said sleeves comprise elbow supporting straps configured to adjustably wrap circumferentially around an elbow of the person wearing the garment.

12. The adjustable shoulder and arm supporting garment of claim 10, wherein said sleeves comprise wrist supporting straps configured to adjustably wrap circumferentially around a wrist of the person wearing the garment.

* * * * *

UNITED STATES PATENT AND TRADEMARK OFFICE

CERTIFICATE OF CORRECTION

PATENT NO. : 8,341,772 B1
APPLICATION NO. : 12/656257
DATED : January 1, 2013
INVENTOR(S) : Alfred Flores It is certified that error appears in the above-identified patent and that said Letters Patent is hereby corrected as shown below:

Column 1
Line 47, Change “train” to “training”

Signed and Sealed this
Twenty-sixth Day of February, 2013

Teresa Stanek Rea
*Acting Director of the United States Patent and Trademark Office*